US007303000B2

(12) United States Patent
Norman et al.

(10) Patent No.: US 7,303,000 B2
(45) Date of Patent: Dec. 4, 2007

(54) MOUNTING SYSTEM AND METHOD FOR SCRAPED SURFACE HEAT EXCHANGER BLADES

(75) Inventors: Drew Van Norman, Whitewater, WI (US); Curt Hagen, Delavan, WI (US); Benjamin Hardy, Elkorn, WI (US)

(73) Assignee: SPX Corporation, Charlotte, NC (US)

( * ) Notice: Subject to any disclaimer, the term of this patent is extended or adjusted under 35 U.S.C. 154(b) by 605 days.

(21) Appl. No.: 10/909,314

(22) Filed: Aug. 3, 2004

(65) Prior Publication Data

US 2006/0027358 A1 Feb. 9, 2006

(51) Int. Cl.
*F28F 5/00* (2006.01)

(52) U.S. Cl. ..... 165/94; 366/311

(58) Field of Classification Search ..... 165/94; 366/311; 62/354

See application file for complete search history.

(56) References Cited

U.S. PATENT DOCUMENTS 3,216,042 A * 11/1965 Strittmatter ..... 15/246.5
3,385,354 A * 5/1968 Bevarly ..... 165/94
3,951,564 A * 4/1976 Montgomery ..... 408/29
5,485,880 A * 1/1996 Zeuthen ..... 165/94
5,810,073 A * 9/1998 Holdt et al. ..... 165/94
6,966,757 B2 * 11/2005 Hardy et al. ..... 416/204 R
7,237,944 B2 * 7/2007 Hardy et al. ..... 366/311

* cited by examiner

*Primary Examiner*—Allen J. Flanigan
(74) *Attorney, Agent, or Firm*—Baker & Hostetler LLP

(57) ABSTRACT

A blade for mounting to a scraped surface heat exchanger drive shaft by pivotal connection with a mounting pin has a blade body having a first side and a second side, and a scraper edge and a hinge edge. At least one mounting hole extends through the blade body generally proximate at the hinge edge. An L-shaped locking track protrudes into the first set of the blade, having an entry track extending from the hinge edge and an intermediate track extending from the entry track to the mounting hole. An L-shaped locking track also protruding into the second side of the blade, has an entry track extending from the hinge edge of the blade and an intermediate track extending from the entry track to and past the mounting hole.

15 Claims, 12 Drawing Sheets

MOUNTING SYSTEM AND METHOD FOR SCRAPED SURFACE HEAT EXCHANGER BLADES

FIELD OF THE INVENTION

The invention pertains to the field of scraped surface heat exchangers. More particularly, the invention pertains to the mounting of blades for a scraped surface heat exchanger onto the central drive shaft.

BACKGROUND OF THE INVENTION

Scraped surface heat exchangers are in wide use in industry, for example in the processing of foodstuffs. A scraped surface heat exchanger generally includes a long cylindrical outer tube having a material inlet at one end and a material outlet at the other end. A central drive shaft extends inside the outer tube and is coaxial with the outer tube and is driven to rotate inside the outer tube. An annular space between the outer tube and central drive shaft receives the material, such as a foodstuff, which is pumped in the inlet and allowed to travel the length of the tube and escape out the outlet at the other end of the outer tube. Heating or cooling is generally provided to the outer tube so that material changes temperature as it traverses the length of the scraped surface exchanger. Further, radially extending paddles, also referred to as blades, are hingedly connected to the central drive shaft in order to help mix the material and/or scrape the inside surface of the outer tube to prevent material buildup.

In one known way of mounting the blades to the tube, the blade is in the form of a generally rectangular relatively thin flat blade member, with a scraping edge along one side, and an opposed hinge side which is hingedly connected to the drive shaft by means of pins. The pins are items welded onto the drive shaft and generally have a narrow protruding finger as well as an opposed wider finger. The thickness of the blade is dimensioned to slide between the two figures of the pin at an installation angle, and a hole is provided in the blade to which the inner finger can pass through. After the blade is inserted at the installation angle, it is pivoted to a much more shallow angle more tangential with drive shaft, at which point the inner finger protrudes through the hole in the blade thereby restraining the blade from lateral movement and permitting only angular movement. A blade typically has two such mounting connections, i.e., two pin receiving holes. The shaft is provided with pins at appropriate locations so that each blade is typically restrained by two, or sometimes more, of these hinged pin connections.

The blades are generally installed on the drive shaft in this manner at a time when the drive shaft is removed from the outer tube of the scraped surface heat exchanger. Installation occurs not only at initial setup, but also after each cleaning cycle of the device, which can occur frequently. During insertion of the drive shaft into the scraped surface heat exchanger tube, it is desirable that the blades remain at the shallow angle so that the fingers are protruding through the holes in the blades and the blades are retained in place during installation. Further, the blades need to be held at their relatively shallow angle during installation so that they fit within the diameter of the outer tube and the drive shaft can be slid into the outer tube.

In the case of a horizontally and vertically arranged scraped surface heat exchanger, this practice may be somewhat cumbersome and require tying strings around the blades to hold the blades in, or may be accomplished by the user holding the blades in with their hands as the drive shaft is inserted into the outer tube.

Due to the length of a drive tube, there are typically several blades arranged at regular intervals longitudinally along a single drive shaft. Also, the blades are generally arranged with four blades, each at a 90° angle to each other, around the circumference of the drive tube, at each blade location.

It would be apparent that if the blades are permitted to swing outwardly to their installation position, depending on their orientation, they may be able to freely slide away from the pin, since the inner finger is not restraining them by engagement with the hole in the blade. This problem becomes even more severe in the case of a vertically arranged scraped surface heat exchanger. In order to permit a shaft, which in some instances may be 7-8 feet long, to fit within a tube of the same length, it is known to mount the tubes quite high above the floor surface, and insert the drive shaft using a hydraulic lift controlled by a manually actuated lever at the floor level. With a vertically oriented tube in this configuration, during installation if the blades swing out to their installation angle position, they will then fall freely downward, which is undesirable and requires the operator to reposition them again before proceeding.

Accordingly, is would be desirable to have a method and apparatus to facilitate the mounting of a scraped surface heat exchanger blade onto a drive shaft, while still using a pin type connection.

SUMMARY OF THE INVENTION

The foregoing needs are met, to a great extent, by the present invention, wherein in one aspect an apparatus is provided that in some embodiments facilitates the mounting of a scraped surface heat exchanger blade onto a drive shaft, while still using a pin type connection.

In accordance with one embodiment of the present invention, a blade for mounting to a scraped surface heat exchanger drive shaft by pivotal connection with at least one mounting pin, the blade comprising a blade body having a first side and a second side, and a scraper edge and a hinge edge, at least one mounting hole extending through the blade body generally proximate to the hinge edge, a first L-shaped locking track protruding into the first side of the blade, having a first entry track extending from the hinge edge and a first intermediate track extending from the first entry track to the mounting hole, and a second L-shaped locking track protruding into the second side of the blade, having a second entry track extending from the hinge edge and a second intermediate track extending from the second entry track to and past the mounting hole.

In accordance with another embodiment of the present invention, a scraped surface heat exchanger, comprising a drive shaft having at least one mounting pin mounted to the drive shaft, and a blade having, a blade body having a first side and a second side, and a scraper edge and a hinge edge, at least one mounting hole extending through the blade body generally proximate to the hinge edge, a first L-shaped locking track protruding into the first side of the blade, having a first entry track extending from the hinge edge and an intermediate track extending from the entry slot to the mounting hole, and a second L-shaped locking track protruding into the second side of the blade, having a second entry track extending from the hinge edge and an intermediate track extending from the second entry track to and past the mounting hole.

In accordance with another embodiment of the present invention, a blade for mounting to a scraped surface heat exchanger drive shaft by pivotal connection with a mounting pin, the blade comprising a blade body having a first side and a second side, and a scraper edge and a hinge edge at least one receiving means extending through the blade body generally proximate to the hinge edge, a first L-shaped locking means protruding into the first set of the blade, having an entry track extending from the hinge edge and an intermediate slot extending from the entry track to the pin receiving means, and a second L-shaped locking means protruding into the second side of the blade, having a second entry track extending from the hinge edge and a second intermediate track extending from the second entry slot to and past the pin receiving means.

In accordance with another embodiment of the present invention, a method for mounting a blade to a scraped surface heat exchanger drive shaft by pivotal connection with a mounting pin, comprising providing a blade body having a first side and a second side, and a scraper edge and a hinge edge with at least one mounting hole extending through the blade body generally proximate to the hinge edge, and locking the blade against longitudinal movement in one direction while permitting pivoting movement relative to the drive shaft, using tracks on both sides of the blade interfering with the pin.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
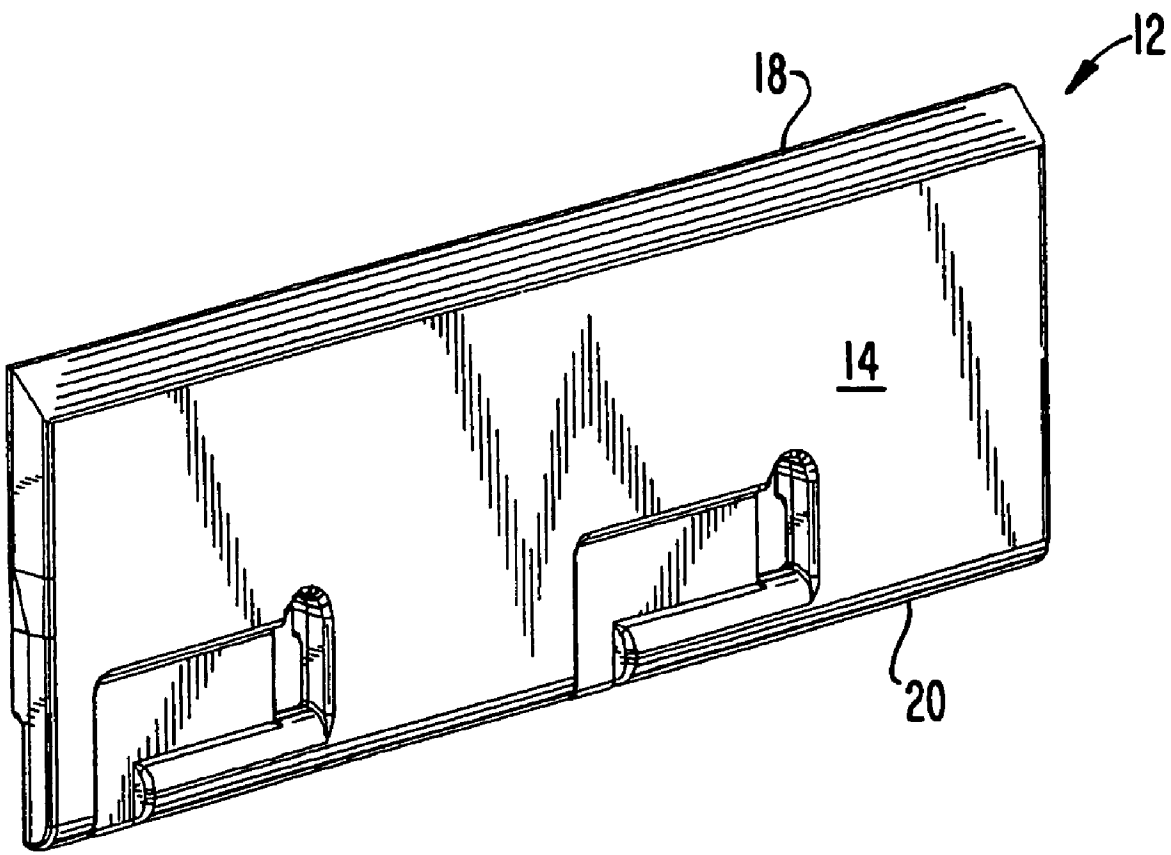
FIG. 1 is a perspective view of a scraped surface heat exchanger blade according to a preferred embodiment of the invention.

Referring now to the drawings, in which like reference numerals refer to like parts throughout, a blade 12 according to the preferred embodiment is illustrated in FIGS. 1-7. The blade 12 includes a first side 14, which is a radially inwardly facing side of the blade in the installed operative state, and a second outwardly facing side 16, which is outwardly facing in the installed state.

Figure 2:
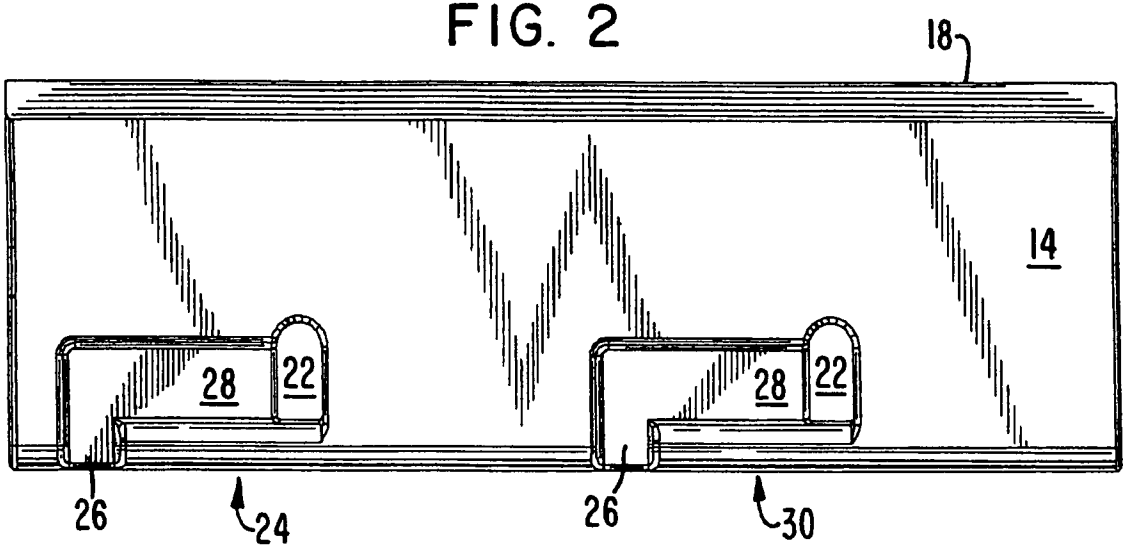
FIG. 2 is a plan view of the blade of FIG. 1 showing a first, inner side thereof.

A blade edge 18 is provided at one side of the blade, and is opposite to a hinge edge 20. A pair of mounting holes 22 are provided in the blade as shown. Each mounting hole 22 extends completely through the thickness of the blade 12. Turning to FIG. 2, in particular, one of the holes 22 has adjacent to it a L-shaped track 24, which includes an entry track 26 and intermediate track 28. FIG. 2 illustrates a blade with 2 mounting holes 22, having a first track 24 associated with one mounting hole 22 and a second slot 30 associated with the other mounting hole 22. The second track 30 is substantially identical to the track 24 and includes an entry track 26 and an intermediate track 28.

Figure 3:
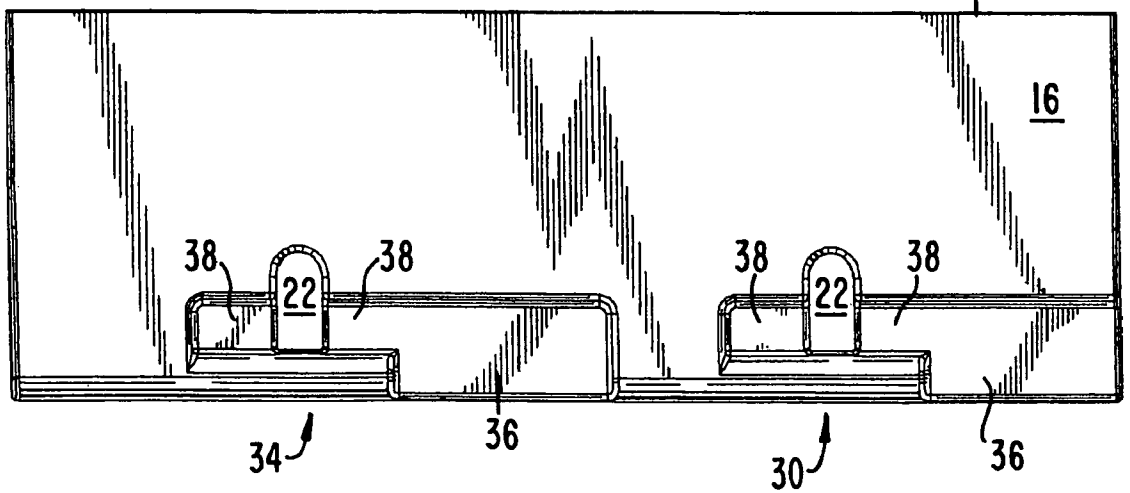
FIG. 3 is a plan view of the blade of FIG. 1 showing a second, outer side thereof.
Figure 4:
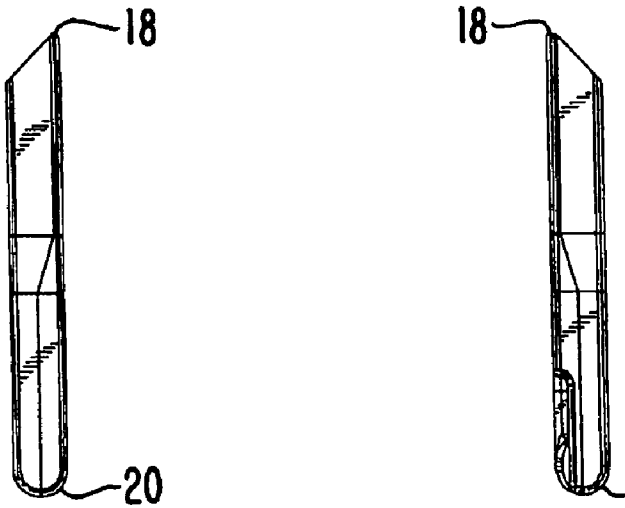
FIG. 4 is a side view of the blade of FIG. 1.
Figure 5:
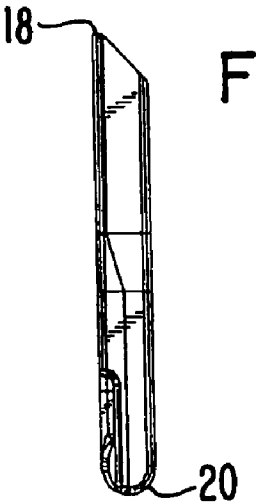
FIG. 5 is a side view of the blade of FIG. 1 taken from the opposite side of FIG. 4.
Figure 6:
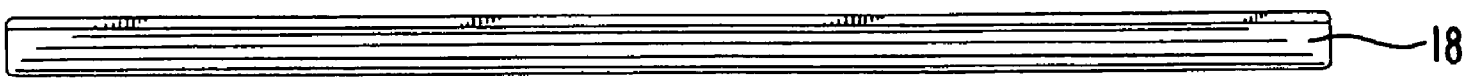
FIG. 6 is an end view of the blade of FIG. 1.
Figure 7:
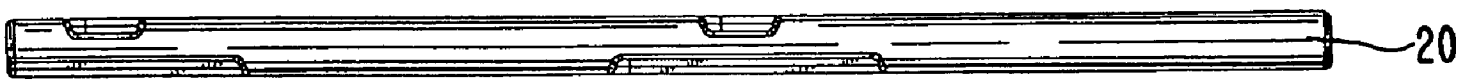
FIG. 7 is an end view of the blade of FIG. 1 taken from an opposite end thereof.

Turning to FIG. 3, on the other side of the blade, one mounting hole 22 is shown with a locking track 34, which includes an entry track 36 and an intermediate track 38. Intermediate track 38 is present on both sides of the hole 22. Associated with the other hole 22 is another locking track 38, which is substantially identical to locking track 34, and includes an entry track 36 and a intermediate track 38.

Figure 8:
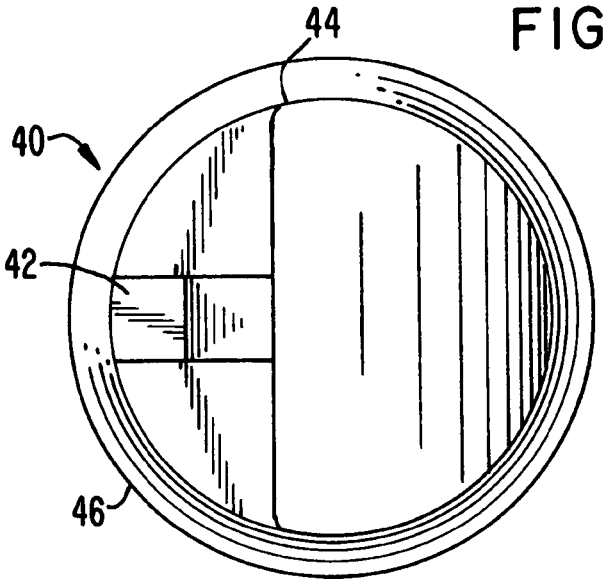
FIG. 8 is a plan view of a pin used in a preferred embodiment of the invention.
Figure 9:
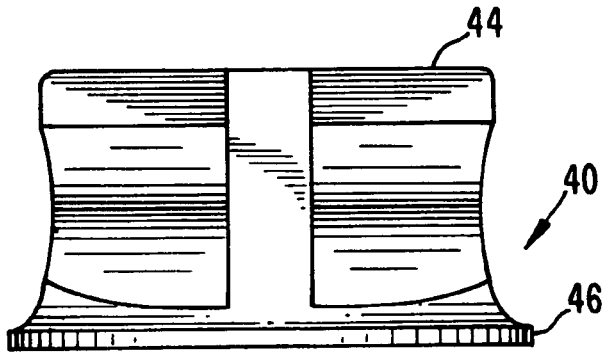
FIG. 9 is a front view of the pin of FIG. 8.
Figure 10:
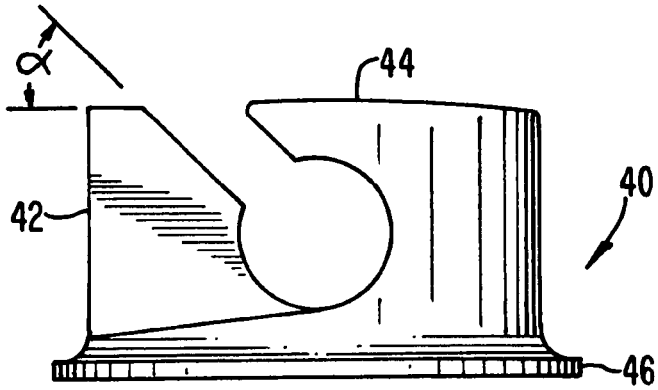
FIG. 10 is a side of the pin of FIG. 8.

Turning to FIG. 8, a representative pin 40 is illustrated. The pin 40 includes an inner finger 42 as well as an outer finger 44 and a base 46 which is mounted to the drive shaft of the scraped surface heat exchanger, usually by welding. FIGS. 9 and 10 show further details of the pin 40.

Figure 11:
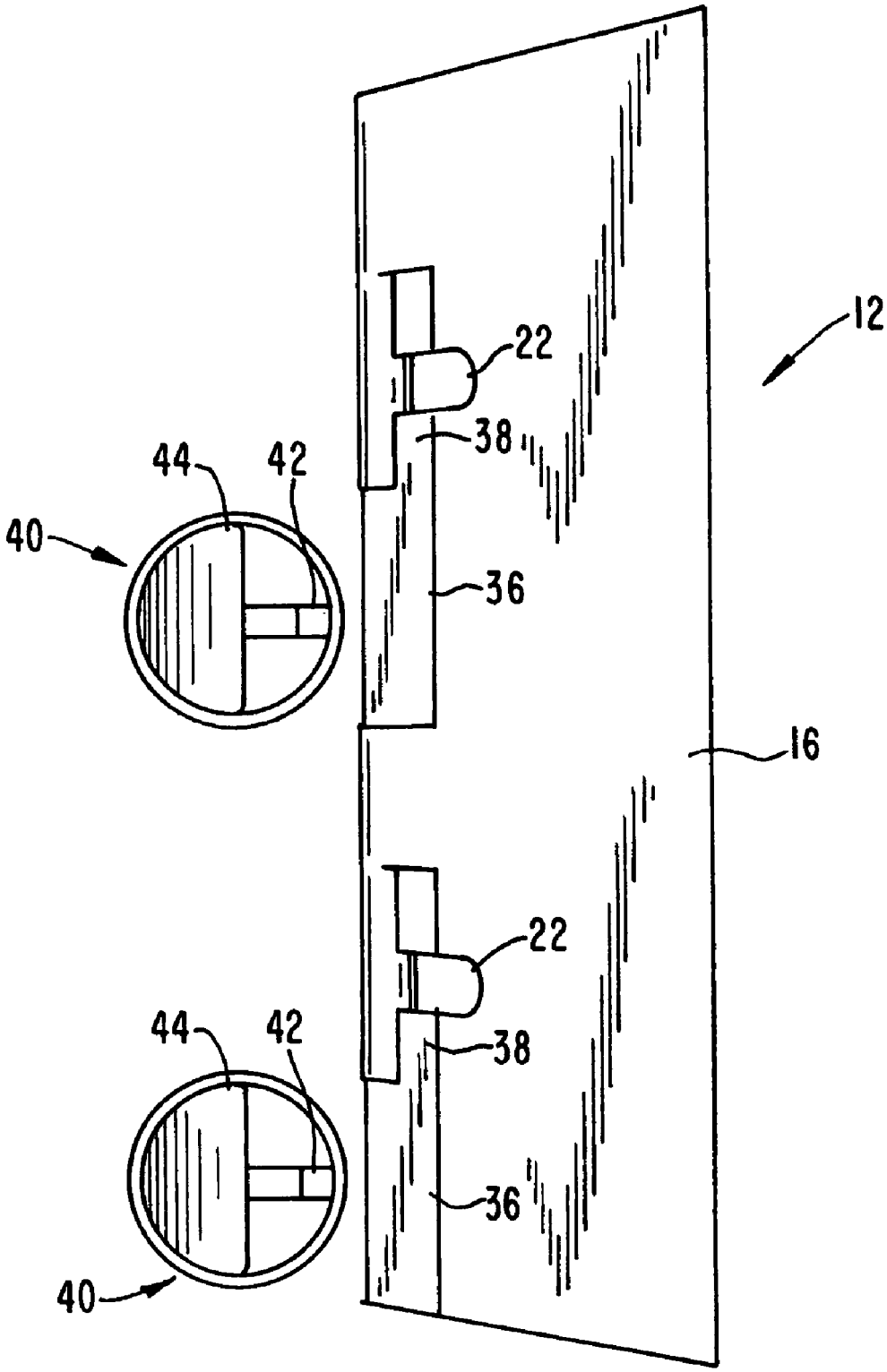
FIG. 11 is a perspective view of a blade and pin assembly at the beginning of the installation process.
Figure 12:
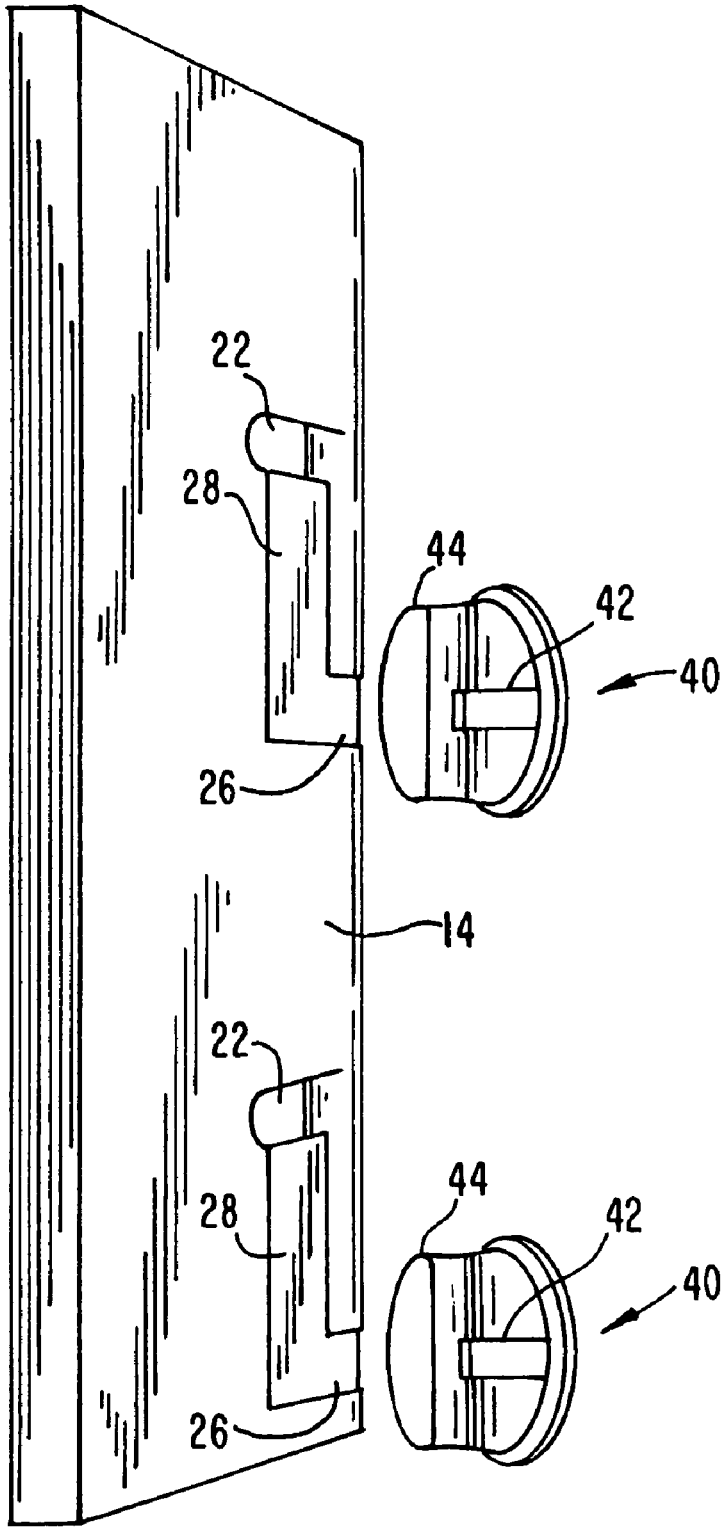
FIG. 12 is a perspective view of a blade and pin assembly at the beginning of the installation process.

The mode of installation of a blade 12 onto a shaft by virtue of the locking tracks will now be described with reference to FIGS. 11-18. FIGS. 11 and 12 show the blade 12 at the beginning of the installation sequence. The blade 12 is placed at an angle relative to the pins 40 corresponding to the angle illustrated in FIG. 10. Turning back to FIGS. 11 and 12, can be seen in FIG. 11 that the upper fingers 44 are each aligned with respective entry tracks 36. The entry tracks 36 have a width that is preferably just slightly greater than the width of the outer finger 44. Turning to FIG. 12, it is appreciated that the inner fingers 42 are aligned with respective entry tracks 26, with the entry tracks 26 having a width slightly greater than the width of the fingers 42.

Figure 13:
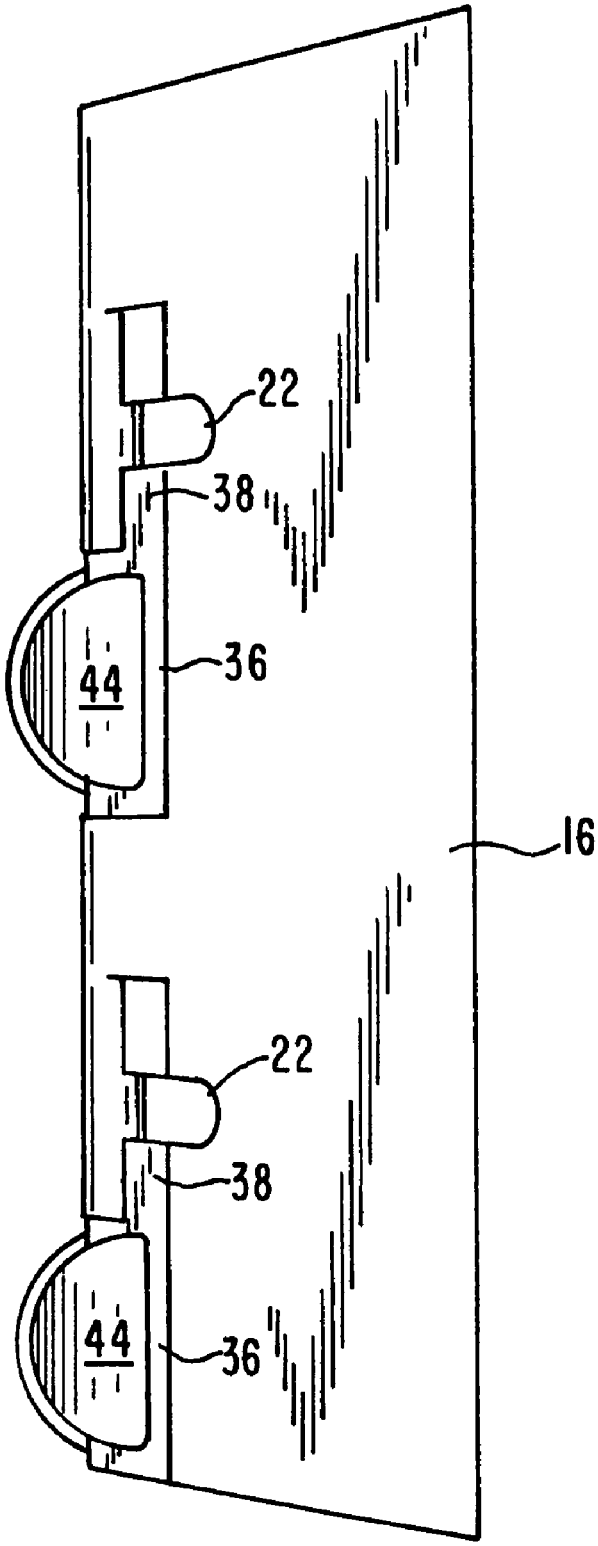
FIG. 13 is a perspective view of a blade and pin assembly during a next step of the installation process.
Figure 14:
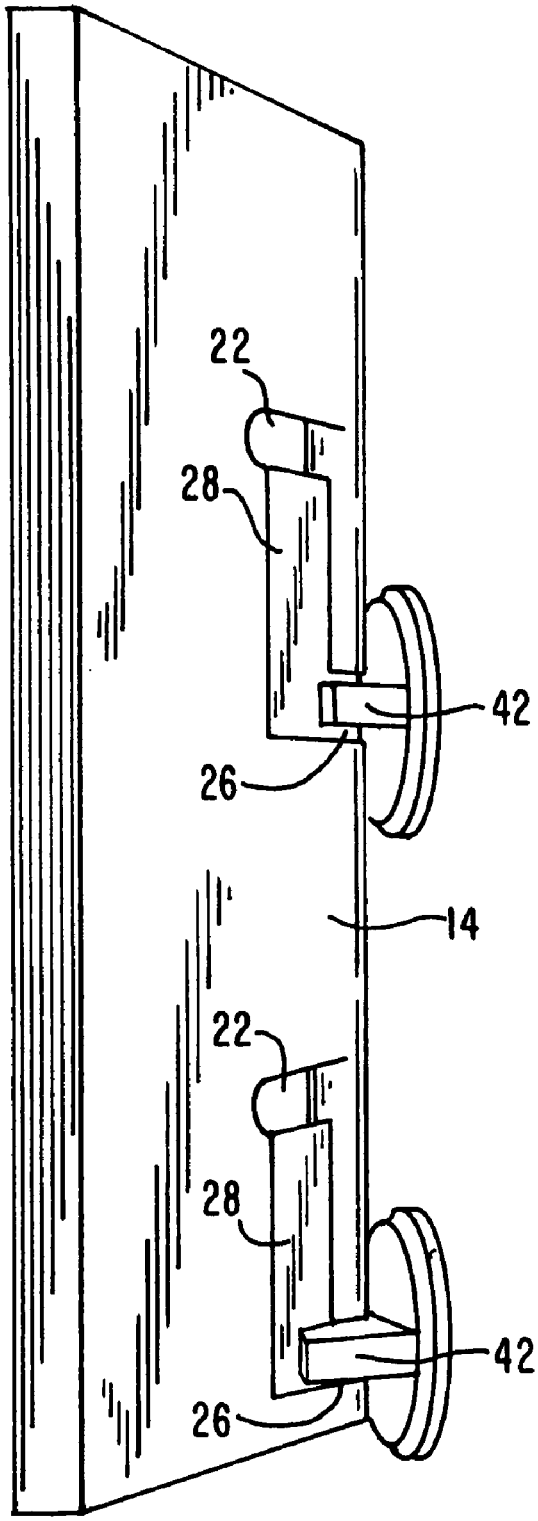
FIG. 14 is perspective view of a blade and pin assembly at the step of FIG. 13.

Turning to FIGS. 13 and 14 the blade is now being inserted between the fingers 44 and 42 of the pin 40. FIG. 13 illustrates the outer finger 44 sliding into the entry tracks 36. FIG. 14 illustrates the inner finger 42 sliding into the entry tracks 26. At this point, due to the angled surface of the inner finger 42, the blade is held at angle alpha by contact between the fingers 42 and 44.

Figure 15:
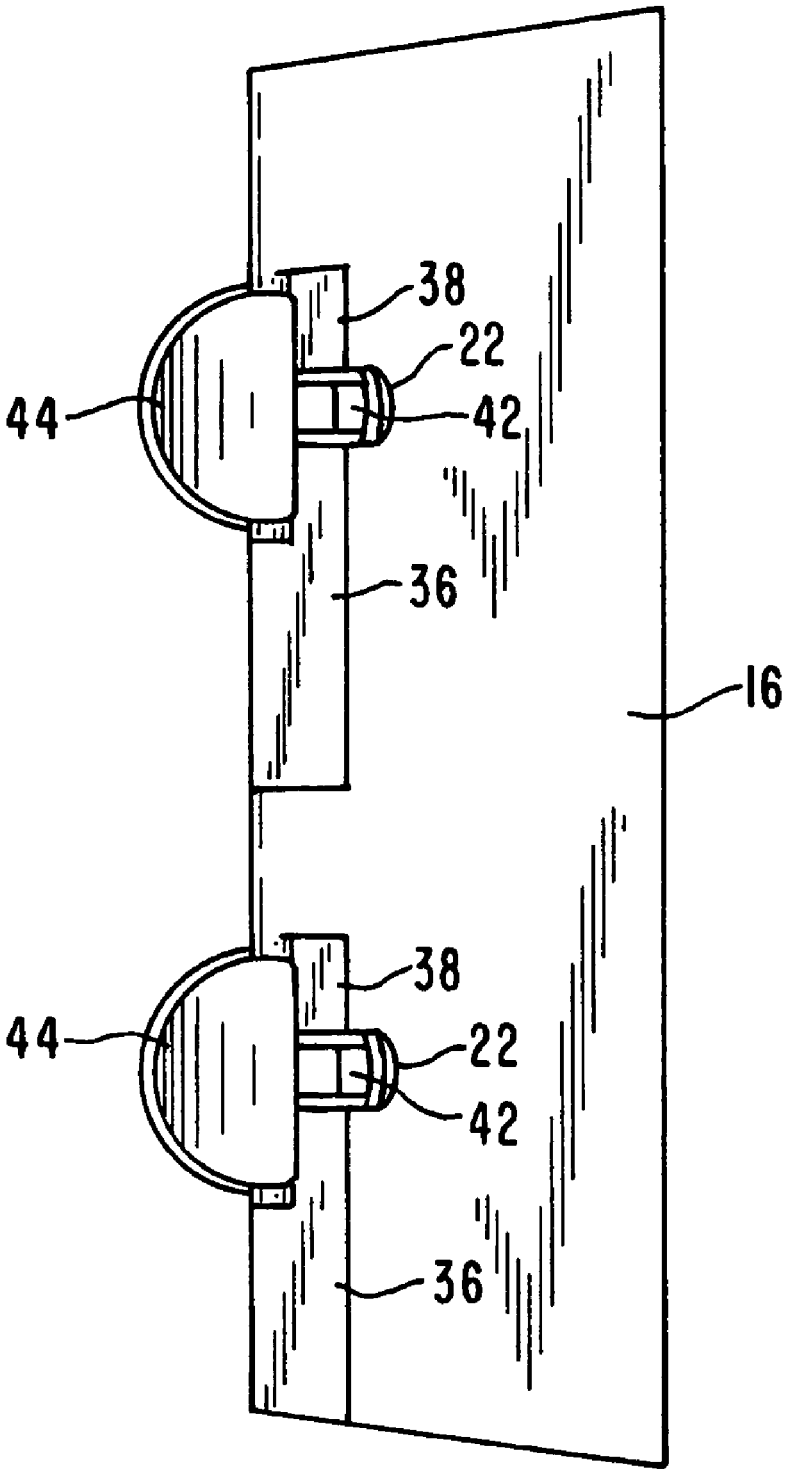
FIG. 15 is a perspective view of a blade and pin assembly during a next step of the installation process.
Figure 16:
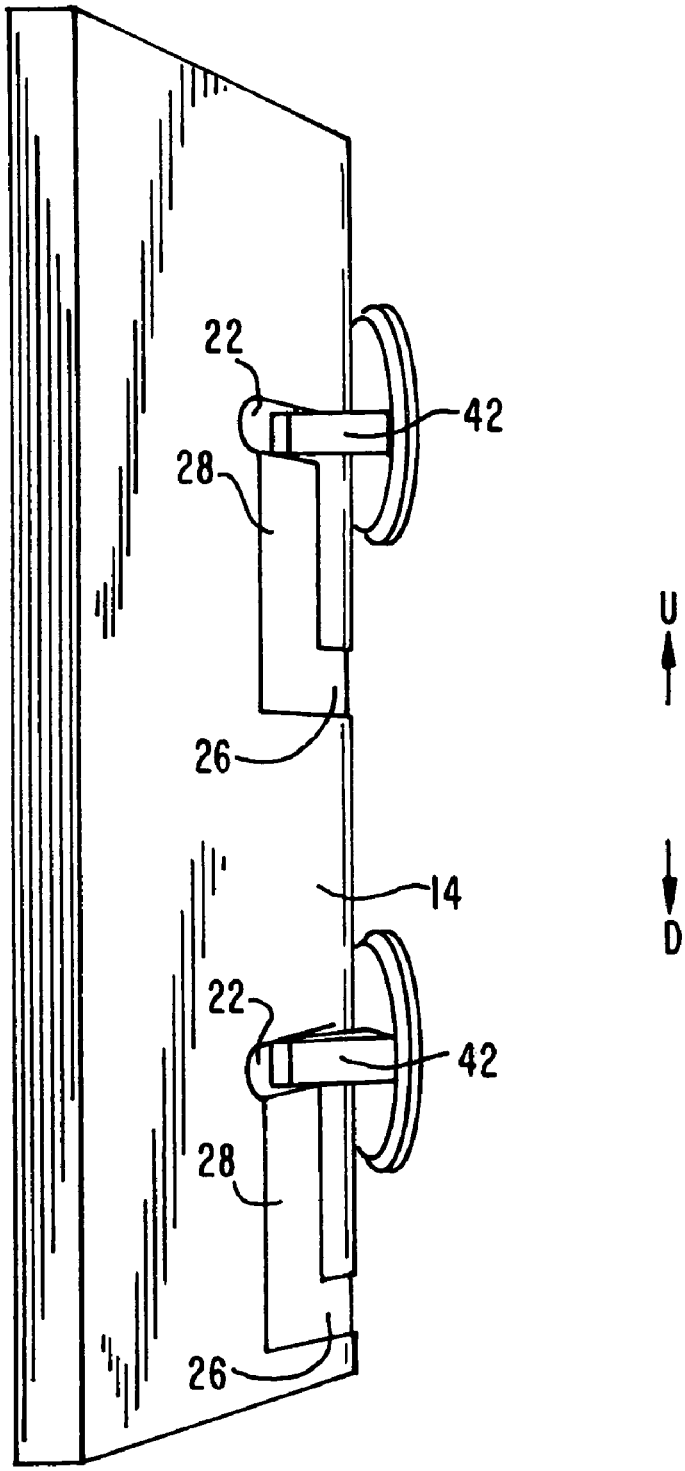
FIG. 16 is a perspective view of a blade and pin assembly at the step of FIG. 15.

Turning now to FIGS. 15 and 16, the blade has been moved longitudinally so that the inner fingers 42 are now aligned with the mounting holes 22. The inner fingers 42 have traversed the intermediate tracks 28. The outer finger 44 has traversed the intermediate track 36. It would be appreciated that the intermediate slot 28 extends only as far as to the hole 22, because the inner finger 42 will now fit within the mounting hole 22. However, the intermediate slot 38 extends past the hole 22, to accommodate the width of the outer finger 44.

In the position shown in FIGS. 15 and 16, the blade 12 is illustrated at the angle alpha. In this position, the blade 12 could be slid back towards the position shown in FIGS. 13 and 14. However, travel in the opposite direction is prevented due to the fact that the intermediate track 28 does not extend past the hole 22. In the case of a vertically oriented scraped surface heat exchanger, the arrangement would be positioned so that direction shown by the arrow U in FIG. 16 refers to upward, and the direction indicated by the arrow D would refer to downward. In the case of either a horizontal or vertical heat exchanger, the direction indicated by U would typically indicate a direction of insertion of the drive shaft, and the direction indicated by D would indicate a direction of removal.

Figure 17:
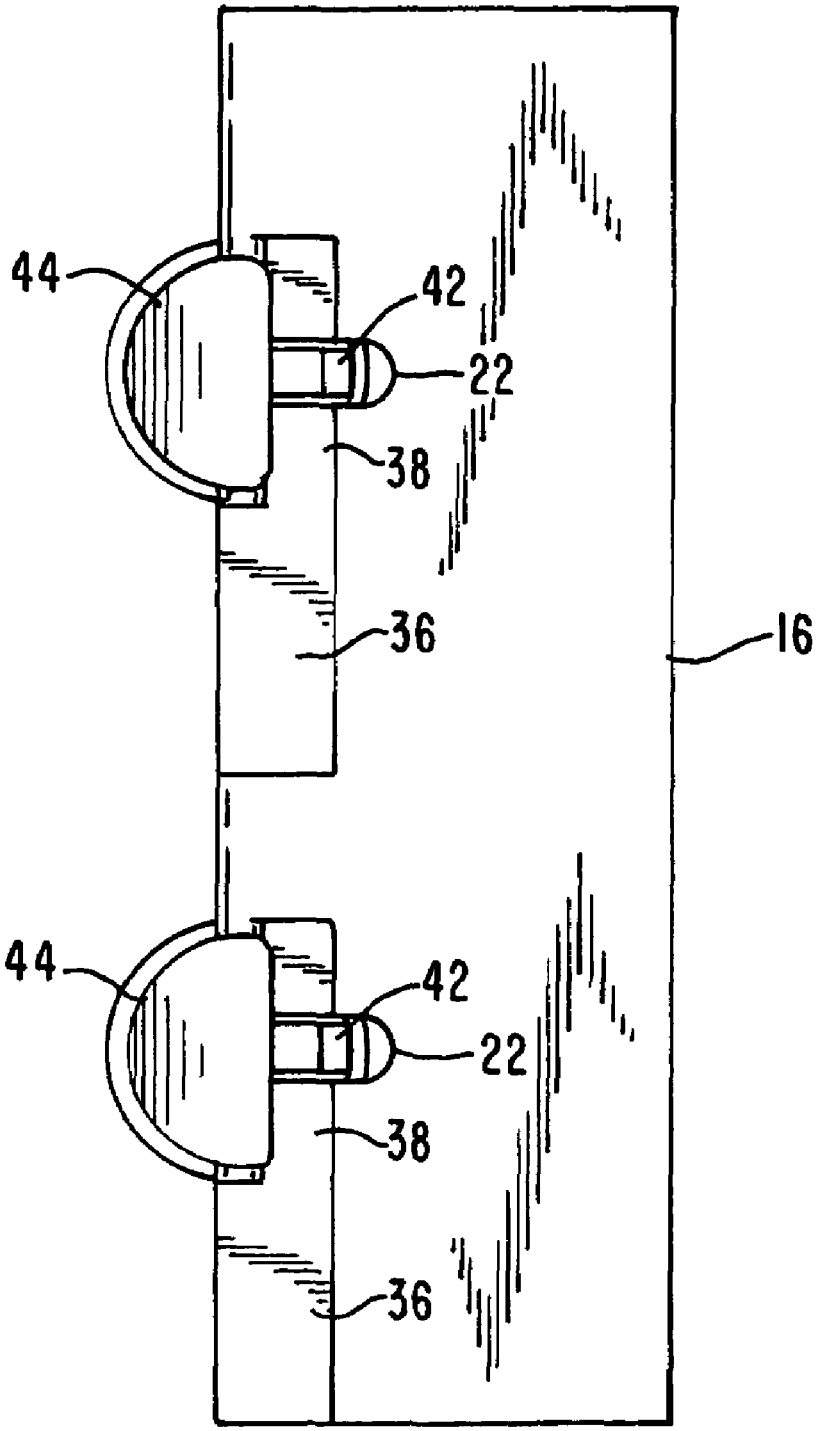
FIG. 17 is a perspective view of a blade and pin assembly at a final step of the installation process and in an operative position.
Figure 18:
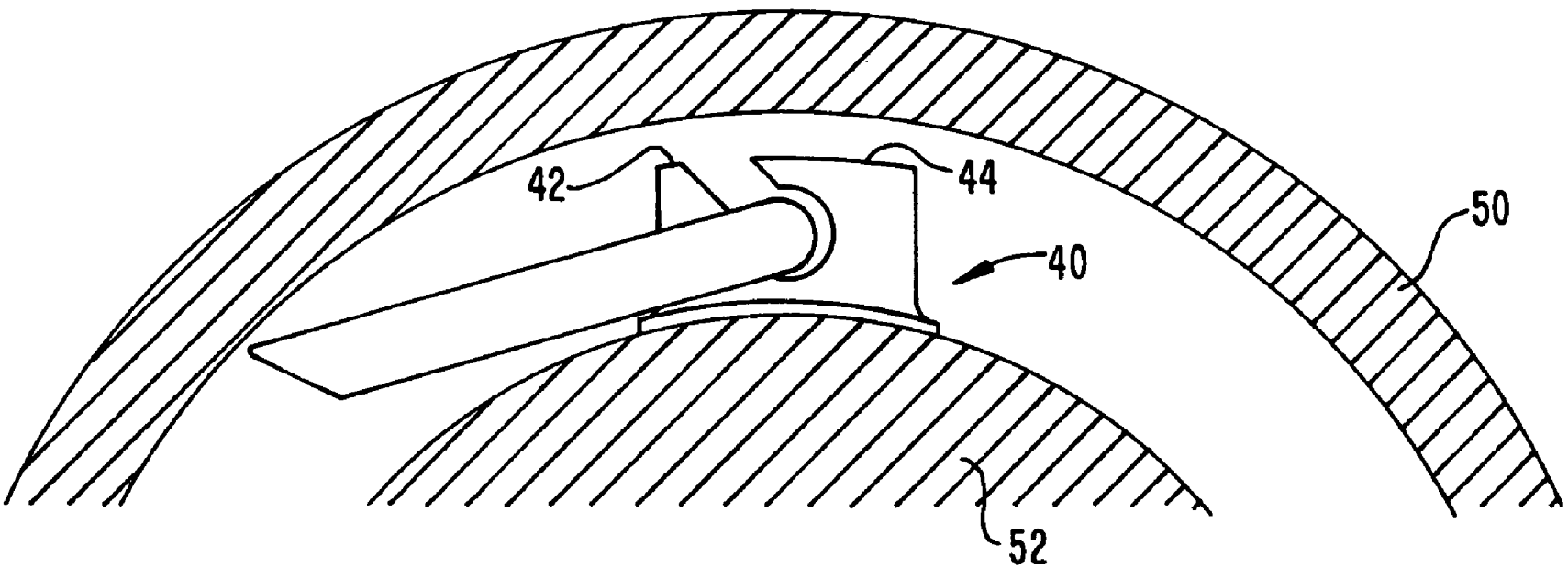
FIG. 18 is a side view of a blade and pin assembly in the installed orientation corresponding to FIG. 17.

Turning to FIGS. 17 and 18, the blade 12 is now shown located longitudinally in the position shown in FIGS. 15 and 16, i.e., with the inner fingers 42 aligned with the mounting holes 22, but has now been angularly rotated downward into an installation position, as particularly seen in FIG. 18, wherein the blade 12 is at a sufficiently shallow angle to fit within an outer tube 50 of the heat exchanger of being mounted to the drive shaft 52 by the pins 40.

Looking particularly at FIGS. 15, 16, and 17, it will be appreciated that, especially in a vertical orientation, the blades will not fall downward off the pins no matter what angle they are at. That is, even if the blade is at the installation angle alpha, shown in FIGS. 15 and 16, it still cannot travel downward in the direction D, due to interference present on both sides of the blade. Primarily, the blade is restrained by interference between the top of the finger 42 and the top edge of the opening 22. On the other side, the blade can also be restrained from vertical travel by the interference between the top edge of the outer finger 44, and the top of the intermediate track 38.

This provides a significant benefit of at least some embodiments of the invention, wherein, where the heat exchanger is vertically, each blade can be positioned at the installation angle, slid onto the pins, and then slid downwardly along the pins, until reaching the position shown in FIGS. 15-17. At this point, even if the blades are left free to pivot about any angle in the range of pivot permitted by the pin, the blades will still stay oriented (with their holes 22 aligned with the inner fingers 42) and will not be able slide down or otherwise fall off the pins.

Another advantage of this embodiment is that the entry track 26 is a different width than the entry track 36. As a result, the blade can only be slid onto a pin with the inner side 14 facing downward, i.e., facing towards the inner finger 42, and with the outer side of the blade 16 facing upward, i.e., facing the upper finger 44. This ensures that the blade will be installed with the correct side facing up, and hence in the case of the scraper design shown in FIG. 18, that the scraper edge will be correctly oriented against the inside of the outer tube 50 of the scraped surface heat exchanger.

The only way to remove a blade in this configuration, is to raise the blade, i.e., translate it in the direction shown by arrow U in FIG. 16, until the blade reaches the positions shown in FIGS. 13 and 14, at which point they can be slid off the pins into the positions shown in FIGS. 11 and 12.

Another advantage of the illustrated embodiment, is that the provision of locking tracks is accomplished using tracks on both sides of the blades. This is an advantage because in order to preserve the structural rigidity of the blade, it is desirable that as much of the blade as possible be of the greatest thickness, i.e., close to the same as the overall blade thickness. In order to accomplish the sliding along the tracks, as well as the interference locking features, the blade tracks on the fingers must be dimensioned with some degree of clearance to permit sliding, but with sufficient degree of interference to prevent any out of track movements. By putting tracks on both sides of the blade, each track can be made roughly half as thick as would be required for a single track on one side of the blade. Over time, both blades and pins are subject to wear, and providing the tracks on both sides permits acceptable performance while reducing the amount of thinned track blade area compared to what would be necessary in an arrangement utilizing the tracks only on one side of the blade.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A blade for mounting to a scraped surface heat exchanger drive shaft by pivotal connection with at least one mounting pin, the blade comprising:

a blade body having a first side and a second side, and a scraper edge and a hinge edge;

at least one mounting hole extending through the blade body generally proximate to the hinge edge;

a first L-shaped locking track protruding into the first side of the blade, having a first entry track extending from the hinge edge and a first intermediate track extending from the first entry track to the mounting hole; and a second L-shaped locking track protruding into the second side of the blade, having a second entry track extending from the hinge edge and a second intermediate track extending from the second entry track to and past the mounting hole.

2. The blade of claim 1, wherein the blade is adapted for use with a pin having an inner finger and an outer finger, and wherein the mounting hole is configured to accept insertion of the inner finger therethrough.

3. The blade according to claim 2, wherein the first entry track is wider than the width of the inner finger.

4. The blade according to claim 2, wherein the second entry track is wider than the width of the outer finger.

5. The blade according to claim 2, wherein the blade has two mounting holes each having a respective first locking track and second locking track.

6. A scraped surface heat exchanger, comprising:

a drive shaft having at least one mounting pin mounted to the drive shaft; and a blade having;

a blade body having a first side and a second side, and a scraper edge and a hinge edge;

at least one mounting hole extending through the blade body generally proximate to the hinge edge;

a first L-shaped locking track protruding into the first side of the blade, having a first entry track extending from the hinge edge and an intermediate track extending from the entry slot to the mounting hole; and a second L-shaped locking track protruding into the second side of the blade, having a second entry track extending from the hinge edge and an intermediate track extending from the second entry track to and past the mounting hole.

7. The scraped surface heat exchanger of claim 6, wherein the blade is adapted for use with a pin having an inner finger and an outer finger, and wherein the mounting hole is configured to accept insertion of the inner finger therethrough.

8. The scraped surface heat exchanger according to claim 7, wherein the first entry track is wider than the width of the inner finger.

9. The scraped surface heat exchanger according to claim 7, wherein the second entry track is wider than the width of the outer finger.

10. The scraped surface heat exchanger according to claim 7, wherein the blade has two mounting holes each having a respective first locking track and second locking track.

11. A blade for mounting to a scraped surface heat exchanger drive shaft by pivotal connection with a mounting pin, the blade comprising:

a blade body having a first side and a second side, and a scraper edge and a hinge edge;

at least one pin receiving means extending through the blade body generally proximate to the hinge edge;

a first L-shaped locking means protruding into the first side of the blade, having an entry track extending from the hinge edge and an intermediate slot extending from the entry track to the pin receiving means; and a second L-shaped locking means protruding into the second side of the blade, having a second entry track extending from the hinge edge and a second intermediate track extending from the second entry slot to and past the pin receiving means.

12. The blade of claim 11, wherein the blade is adapted for use with a pin having an inner finger and an outer finger, and wherein the pin receiving means is configured to accept insertion of the inner finger therethrough.

13. The blade according to claim 12, wherein the first entry slot is wider than the width of the inner finger.

14. The blade according to claim 12, wherein the second entry slot is wider than the width of the outer finger.

15. The blade according to claim 12, wherein the pin receiving means comprises a hole extending through the blade.

* * * * *